United States Patent [19]

Ferrari et al.

[11] Patent Number: 4,942,395

[45] Date of Patent: Jul. 17, 1990

[54] RAILROAD GRADE CROSSING MOTORIST WARNING SYSTEM

[76] Inventors: John S. Ferrari, 8030 E. Girard, Denver, Colo. 80231; Dale C. Sommers, Box 867, Conifer, Colo. 80433

[21] Appl. No.: 88,579

[22] Filed: Aug. 24, 1987

[51] Int. Cl.[5] ..... G08G 1/095

[52] U.S. Cl. ..... 340/907; 49/25; 49/49; 246/125; 246/126; 246/127; 246/473.1

[58] Field of Search ..... 340/22, 47, 49, 907, 340/905, 903, 902, 928; 49/25, 49; 246/125–127, 187 A, 473.1–473.3, 292–296, 270 R, 272, DIG. 1; 455/53, 54, 73, 89, 90, 88

[56] References Cited

U.S. PATENT DOCUMENTS

| | | | |
|---|---|---|---|
| 3,758,775 | 9/1973 | Hopkins | 246/125 |
| 3,854,119 | 12/1974 | Friedman et al. | 340/902 |
| 4,093,161 | 6/1978 | Auer, Jr. | 246/187 A |
| 4,108,405 | 8/1978 | Gibson | 246/125 |
| 4,238,778 | 12/1980 | Ohsumi | 340/903 |
| 4,621,252 | 11/1986 | Johns et al. | 340/903 |

FOREIGN PATENT DOCUMENTS

| | | | |
|---|---|---|---|
| 2615797 | 10/1977 | Fed. Rep. of Germany | 340/905 |

*Primary Examiner*—Donnie L. Crosland

[57] ABSTRACT

A three-piece, compact wireless railroad grade crossing motorist warning device comprising: a locomotive mounted transceiver which simultaneously communicates (upon close proximity) with a similar transceiver mounted at railroad grade crossing, and motor vehicles equipped with sympathetic receivers. Upon signal receipt verification, the grade crossing transceiver emits a coded radio signal to local motoring public sympathetic receivers. Upon signal reception, an audio/visual alert is presented to the motor vehicle operator, alerting the motor vehicle operator to the locomotive-occupied railroad crossing. Additionally, a contact verification display is displayed to the operator of the locomotive, upon activation of the grade site transceiver.

2 Claims, 7 Drawing Sheets

RAILROAD GRADE CROSSING MOTORIST WARNING SYSTEM

BACKGROUND OF THE INVENTION

The present invention relates to a compact, 3 piece audio/visual alert system for vehicle operator safety. In recent years as our highways, roadways, airlines and railways have become increasingly congested and heavily travelled by high-speed vehicles, much attention has been given across the world to providing improved vehicle operator safety measures and there have been several products developed to this end, to address ever increasing vehicle operator safety and collision avoidance needs. As vehicles have become quieter and better sound insulated, with powerful stereo systems installed, a vehicle operator's external hearing ability may become impaired to such a degree that the operator may not be cognizant of a fast approaching train or emergency vehicle, even though a siren or flashers are activated or train whistle and horn have been sounded, thus endangering both emergency vehicle operator and vehicle operators in the area.

The present invention is a novel approach to the provision of an improved, durable, miniature wireless alert system for vehicle operator safety. Present inventions warning transceiver is attached to crossbucks at railroad crossings for vehicle operator alert or, is co-activated in addition to emergency vehicle warning systems and will immediately signal to sympathetic receivers nearby, to provide nearby vehicle operators with an audio/visual alert signal and indication of an approaching emergency vehicle or live/passive railroad crossing within the transceiver's omnidirectional and/or linear radio frequency range. To this end, all emergency vehicles/railroad crossing warning device transceivers per the present invention would be a coded broadcast at the legal power limit and at precisely the same frequency as one another.

In a preferred embodiment of the present invention for vehicle operator alert of guarded railroad grade crossings (those crossings with active warning means installed), a vandal and weatherproofed transceiver unit per the present invention would be mounted upon the railroad crossing crossbuck mounting pole, and would be hardwired to the crossings electrical circuit, and/or other electrical circuitry at the grade crossing and would be activated by a powerful shortwave radio signal from the locomotive-mounted transceiver. This would assist in providing vehicle operators with advance visual and/or audio alert of a live railroad crossing, even though the railroad crossing warning lights and signals may not be visible to the vehicle operator upon receipt of the transceivers signal to the operator's vehicle. To this end, all locomotive train warning device transceivers per the present invention would be a coded broadcast at the legal power limit and at precisely the same frequency as one another.

An alternative embodiment of the present invention for vehicle operator alert of passive, unguarded railroad crossings at grade (crossings with no warning signals of an active nature), would consist of a transceiver per the present invention, which would be mounted upon the railroad crossbuck mounting pole, and the transceiver would be intermittently activated by any approaching locomotive-mounted transceiver and will only then be activated to transmit a powerful shortwave radio signal, for sympathetic receiver pickup in the local area. A long-life battery unit powers the vandal proof, durable, weatherproof transceiver unit, and photovoltaic trickle charging is integrally provided for continual and dependable transceiver operation. Upon completion of signal, or when locomotive signal is terminated, said crossbuck-mounted transceiver reverts to a standby mode (no transmission).

It is projected that the Emergency Signal Product Safety System would have application in the air travel industry. With combined transmitter/receiver (transceiver) assembly installed in each aircraft, pilots would be alerted to other aircraft in nearby airspace. This embodiment of the present invention would employ coded digital delay and anti-falsing and anti-feedback means to prevent falsing of signals for dependable operation and would be activated continually or may be activated to transmit during activation of aircraft landing lights or by lowering landing gear.

Alternatively, a school bus stopped, to pick up or dispense school children, with flashers activated and equipped with an alert transceiver would give a coded signal to the motorists in the vicinity and activate an additional warning with a separately marked visual alert light upon receiver faceplate.

A locomotive-locomotive proximity warning safety embodiment of the Emergency Signal Product is also projected, for railroad safety purposes and would operate along the same principle.

An embodiment of the present invention for railroad use would be employed as a railyard worker safety alert and would notify railyard workers of runaway or unpowered freight cars running "silent" in the yard, in the proximity of the yard worker; which is presenting a life threatening situation.

Despite the various means which presently exist for advance alert of vehicle operators to immediate hazards, (i.e., railroad crossing lights, bells and guards, emergency vehicle lights, sirens and horns, school bus flashers, etc.), there still remains a very real need for useful and novel technologies which address the increasing safety needs of the public and present day vehicle operator. This novel invention provides vehicle operators with identifiable visual/audible alert signals to provide for verified advanced notification and collision avoidance and is dependable, durable, miniaturized and adaptable to many usages and is economical to operate and maintain.

SUMMARY OF THE INVENTION

It is a primary object of the present invention to provide for a preferably three-part wireless signaling safety system to alert vehicle operators to potential collision conditions, and provide proximity alert which notifies vehicle operators to the near proximity (1/10–¼ mile) of approaching or nearby emergency situations of all kinds; i.e., hazardous "live" railroad crossings, stopped school buses, emergency or police vehicles and provides vehicle operators with awareness of potential collision conditions in the immediate vicinity and of approaching hazardous conditions requiring the roadway right-of-way immediately.

It is another object of the present invention to provide a three wireless motor vehicle safety system which alerts vehicle operators to the near proximity (1/10–¼ mile) of approaching or nearby emergency vehicles of all kinds, active or passive railroad crossings and stopped school buses comprising a 12 volt, D.C. hardwired vehicular-mounted, transmitter/transceiver unit, operating on a low MHZ radio frequency which is mounted in conjunction with, and is coactivated by the emergency vehicle warning equipment; the transmitter emits a low power shortwave radio signal, which is picked up by any sympathetic receivers in place in vehicles nearby.

It is a further primary object of the present invention to provide a low voltage crossbuck or active railroad crossing-mounted transceiver system which alerts nearby vehicle operators to the near proximity (1/10–¼ mile) of hazardous—"live" railroad crossings—the vehicle is approaching.

It is another object of the present invention to provide a self-contained, 12 volt D.C. hardwired microprocessor signal discriminatory-receiver unit, which is factory tuned to the emergency vehicle/railroad crossing transmitter/transceiver frequency or sympathetic to other determined signal, which is removably or permanently attached to the vehicle with a choice of locations, for operator visibility. When a transmitter-equipped emergency vehicle with emergency light bar and siren on is nearby, a marked visual display light upon the faceplate of the receiver unit lights up and alerts the driver to the emergency vehicle's proximity. When a transmitter-equipped emergency vehicle with emergency light bar on is nearby, a marked visual display of lights upon the faceplate of the receiver, lights and co-activates a voice synthesized audible alert. This receiver will also respond to the signal sent from the railroad grade crossing-mounted transceiver, alerting the vehicle driver through cantilever lights on the receiver faceplate and a voice synthesized audible alert.

It is yet another object of the present invention to provide for an embodiment of the invention, Emergency Signal Product, safety system would have application in the air travel industry. With the transmitter/-receiver (transceiver) assembly installed in each aircraft, pilots would be alerted to other aircraft in the near airspace. This embodiment of the present invention would employ coded digital delay and anti-falsing, and anti-feedback means to prevent falsing of signals, for dependable operation and would be activated continually or may be activated to transmit during the activation of the aircraft landing light or by lowering of the landing gear.

It is a further object of the present invention to provide for a school bus stopped to pick up or dispense school children with warning flashers activated, and a transceiver installed, for this purpose, would also give a coded signal to the driver's receiver and would light yet another separately marked visual alert light upon the receiver's faceplate.

It is another object of the present invention to provide for an embodiment for locomotive-locomotive collision proximity warning safety, and for railyard work safety It is a further object of the present invention to provide an embodiment of the present invention which would have maritime application, to operate in companionship with on-board radar and would alert vessel operators with advance notice of other vessels in the near waters.

DETAILED DESCRIPTION OF THE DRAWINGS

Figure 1:
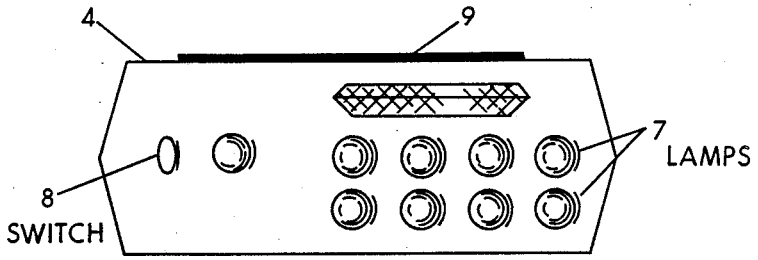
FIG. 1, is a front elevational view of preferred embodiment of the present invention receiver unit.
Figure 2:
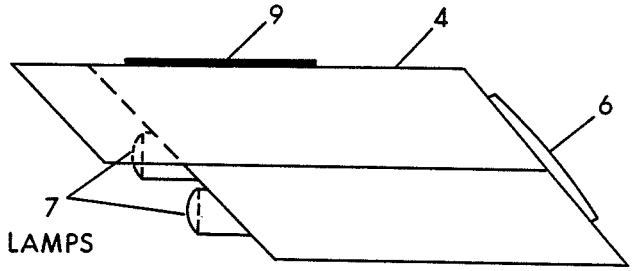
FIG. 2, is a side elevational view of preferred embodiment of the present invention receiver unit.
Figure 3:
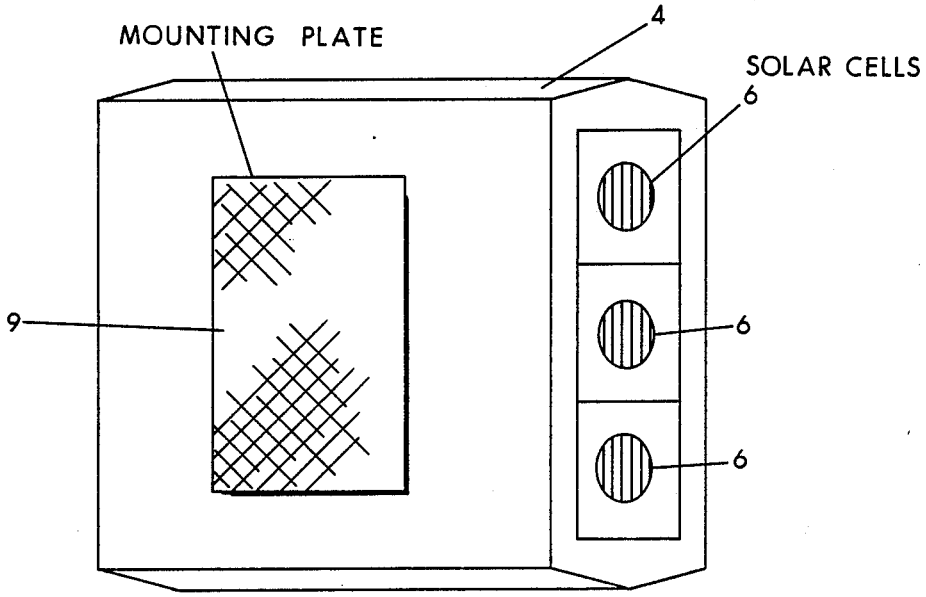
FIG. 3, is a top elevational view of preferred embodiment of the present invention receiver unit.
Figure 4:
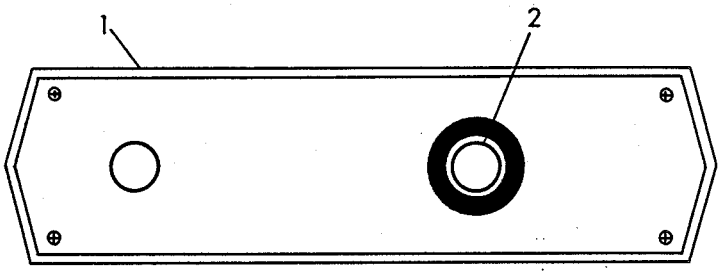
FIG. 4, is a rear elevational view of preferred embodiment of the present invention transceiver unit.
Figure 5:
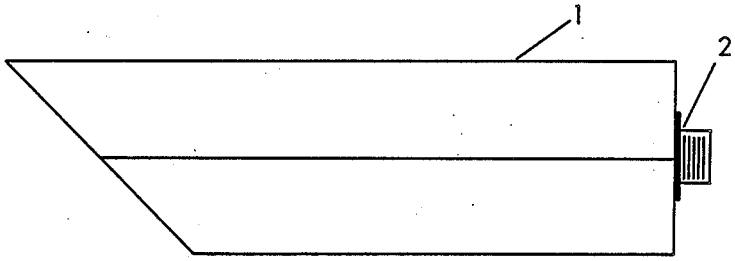
FIG. 5, is a side elevational view of preferred embodiment of the present invention transceiver unit.
Figure 6:
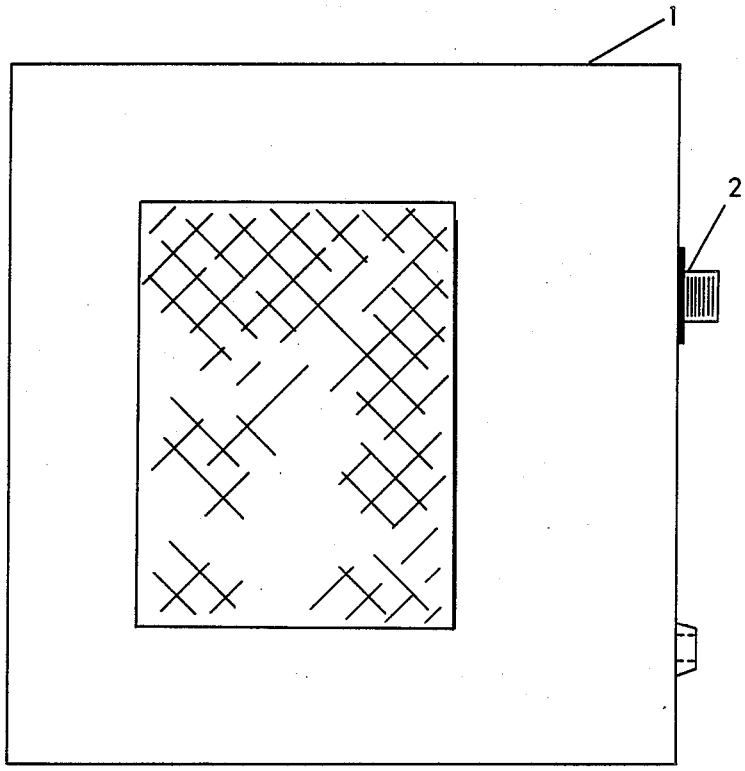
FIG. 6, is a top elevational view of preferred embodiment of the present invention transceiver unit.
Figure 7:
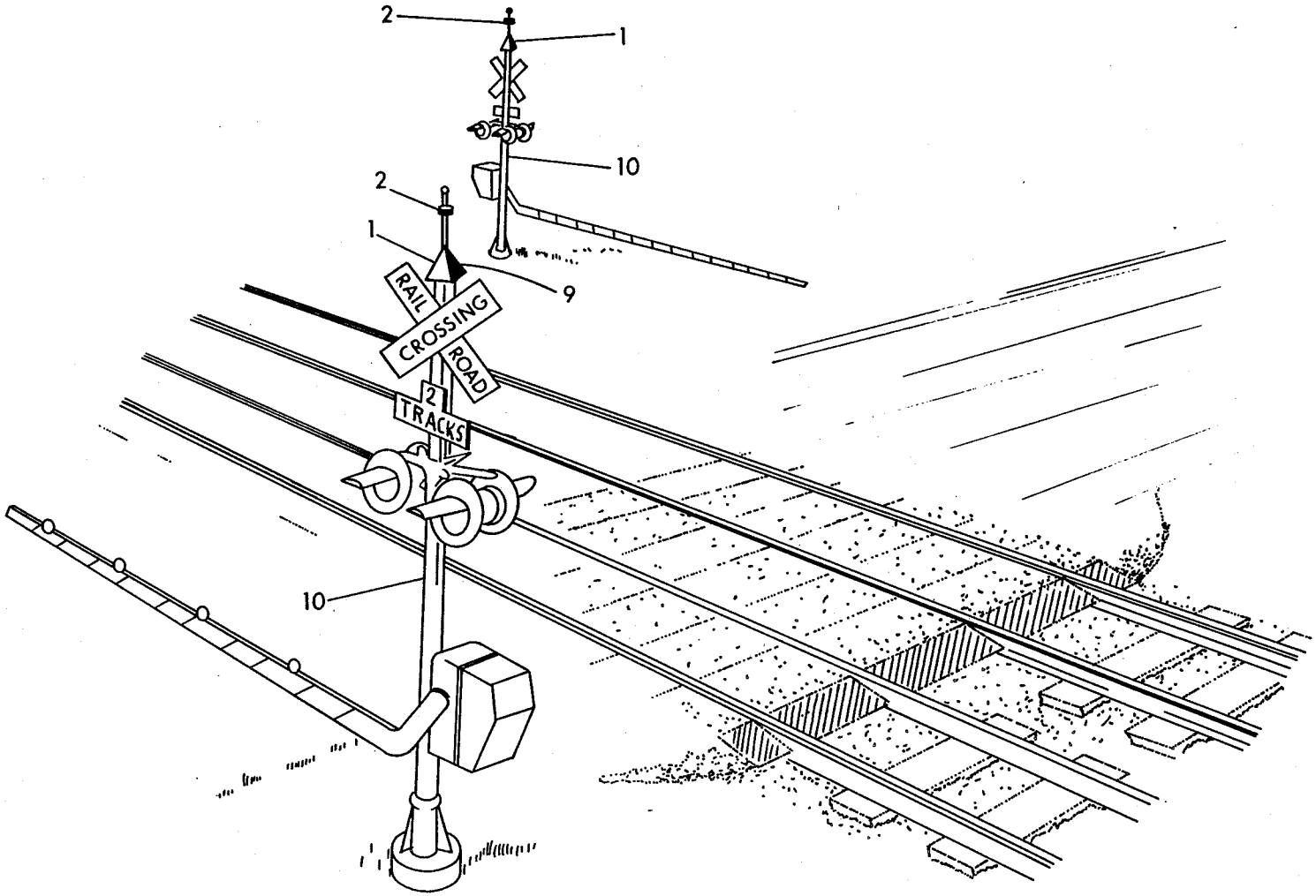
FIG. 7, is an elevational view of a railroad grade crossing illustrating transceivers located upon crossbuck poles.
Figure 8:
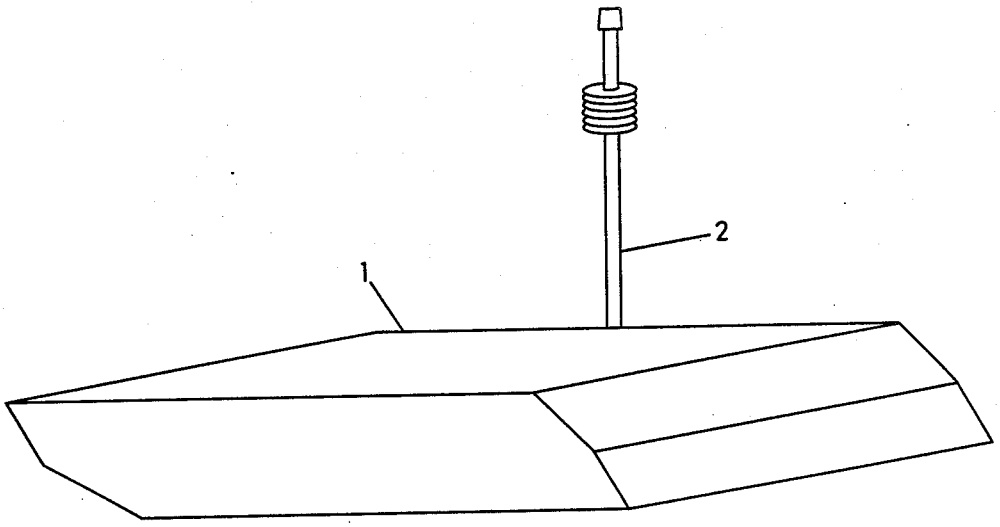
FIG. 8, is a top isometric view of the transmitter embodiment of the present invention.
Figure 9:
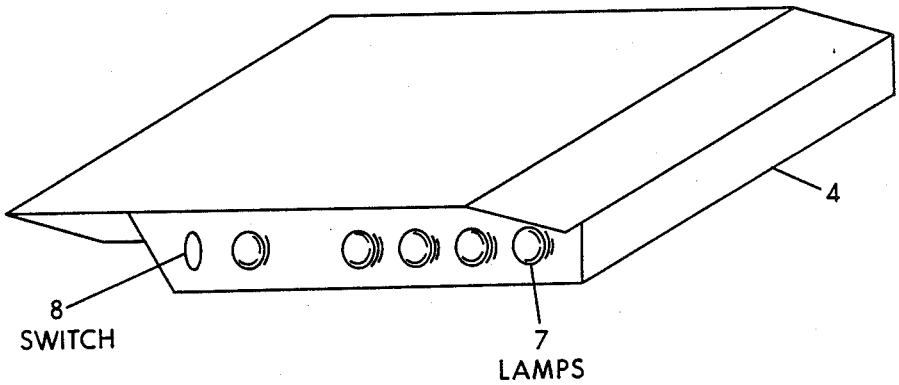
FIG. 9, is a top isometric view of the receiver embodiment of the present invention.
Figure 10:
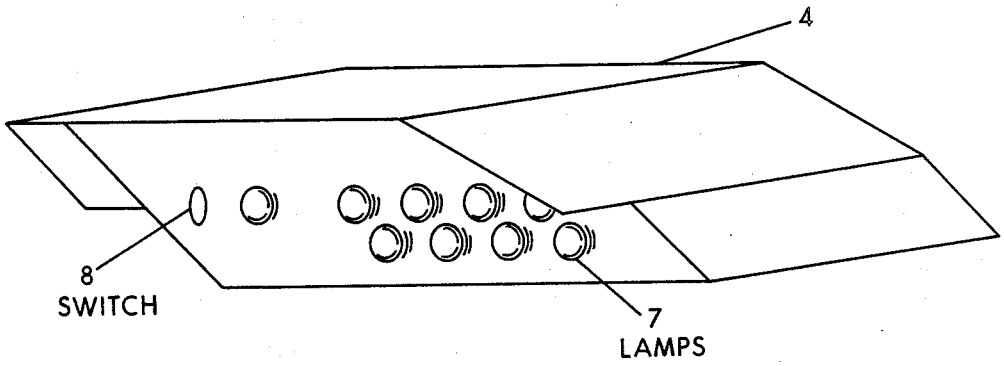
FIG. 10, is a front isometric view of the receiver embodiment of the present invention.
Figure 11:
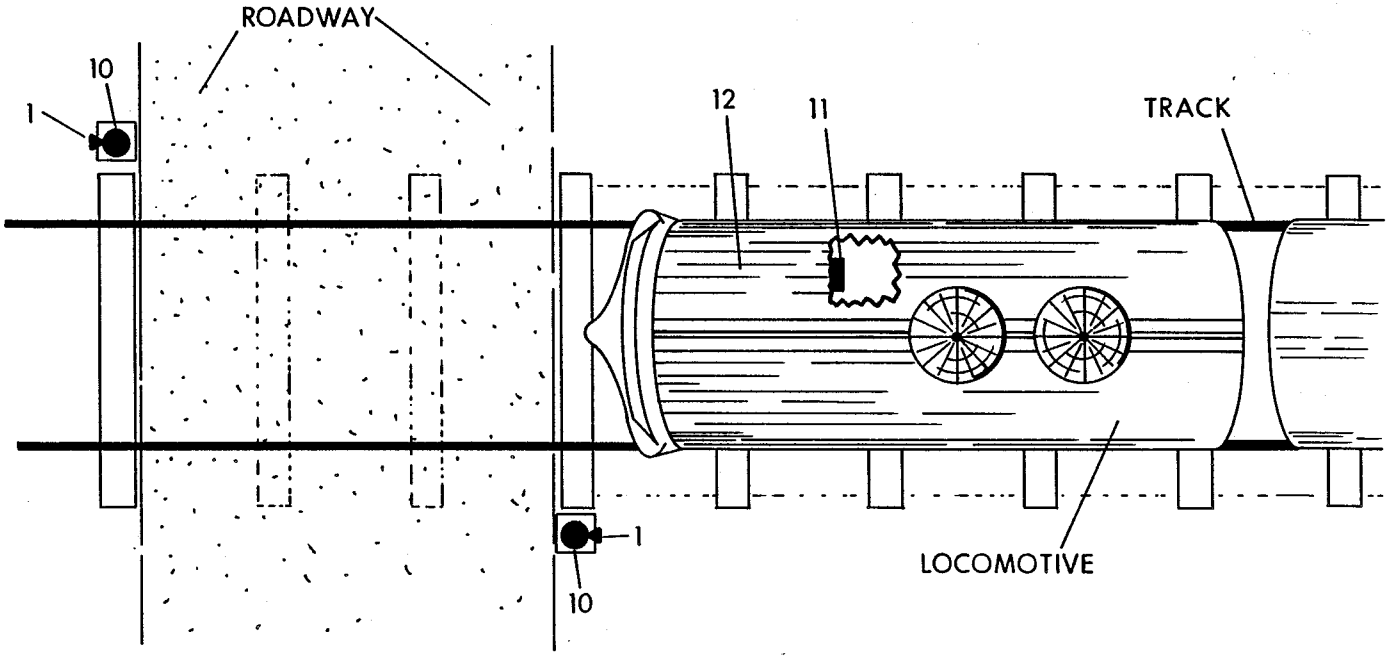
FIG. 11, is a top cutaway elevational view of a locomotive with a transceiver approaching a grade crossing with pole-mounted transceivers.

The present invention, in the preferred embodiment, comprises a compact, preferably three-piece, wireless railroad/automotive/aircraft/maritime safety warning system which alerts vehicle operators to potentially hazardous route conditions, and the features of the present invention are identified in the attached drawings FIGS. 1–11, forming a part of this specification.

In the automotive-emergency vehicle warning embodiment of the present invention, radio frequency transceiver 1 broadcasts an omnidirectional, low power, continuous shortwave signal from its antenna 2, which may be external or internal to the transceiver 1 casing. Transceiver 1 is electrically powered by a feedwire from the emergency siren and lighting apparatus 3 located upon the emergency vehicle, etc., and transceiver 1 is co-activated simultaneously upon power-up of the siren and lighting apparatus 3. A durable mounting plate 9 provides transceiver 1 mountability and adaptability to emergency vehicle apparatus and other equipment and transceiver 1 usages, such as the transceiver 1 unit shown in drawings FIG. 7, as having been mounted upon a railroad crossing "crossbuck," and warning bell and light mounting pole 10, for the purpose of advance motorist alert of "live" railroad grade crossings. In the drawings, transceiver 1 is depicted as being squared in external shape, however, other physical shapes may be employed as a transceiver 1 casing, without departing from the intent and scope of the present invention.

In the railroad grade crossing warning embodiment of the present invention, the transceiver is mounted on the warning bell and light mounting pole 10 in a standby mode prepared to receive the signal from the locomotive-mounted transceiver 1. When the locomotive 12 is in motion, the locomotive-mounted transceiver 1 transmits and so activates the pole mounted transceiver 1 which signal will be subsequently received by any receiver equipped vehicle within range (1/10–¼ mile) of the railroad grade crossing.

Alternatively, a self-powered transceiver 1 unit for prescribed usages (i.e., passive railroad crossings, etc.) would employ a long-life battery for electrical power needs, and would have solar photovoltaic cells 6 located upon the transceiver's 1 casing, to provide for continuous battery charge. This embodiment of the present invention would intermittently broadcast its omnidirectional shortwave radio signal as aforesaid, only upon being contacted by and triggered by a locomotive-mounted transceiver therefore acting as a motorist early alert and a "railroad crossing warning beacon."

Transceiver's 1 shortwave radio signal is collected by a signal discriminatory-sympathetic, 12 volt D.C. battery powered, microprocessor receiver 4 unit, which is either permanently or removably mounted by mounting plate 9 in a motor vehicle or other transport. Receiver 4 radio frequency collection is augmented by an antenna 2 which may be external of receiver 4 casing, or internally provided. Optional photovoltaic solar cells 6 provide receiver 4 with battery charging ability, for continuous operation. Receiver's 4 microprocessor unit identifies and discriminates incoming received radio frequency signals from transceivers 1 located in the vicinity, and subsequently relays an electrical discharge to one or more of several separately marked or separately colored visual display lights 7 and audio chip located internal of the receiver 4 unit, for vehicle operator route hazard alert and notification. An on-off volume control 8 is so labeled and located upon the receiver's 4 faceplate. Various modifications, changes, additions, and applications other than those specifically outlined herein will become readily apparent to those having ordinary skill in the art, without departing from the spirit and scope of the present invention, and may be considered to be within the scope and essence of my invention.

Accordingly, it is desired that the scope and essence of my invention be determined not entirely by the foregoing specification, and the embodiments illustrated in the drawings, but rather be determined by the appended claims and their legal equivalents.

I hereby claim:

1. A system for warning motorists of the approach of a locomotive and train into a highway/rail crossing, comprising:

a locomotive mounted, MHZ radio frequency transceiver "beacon," contructed to provide a constant, directional, outgoing radio signal, and which transceiver is provided with signaling means to inform a locomotive operator that the outgoing radio signal has been received; and an intermittently active, railroad crossing "crossbuck" pole-mounted, encased and weatherproofed, MHZ radio frequency transceiver unit, powered and hardwired in conjunction with existing railroad crossing electrical circuitry, said transceiver activates and emits a omnidirectional, low power, coded shortwave radio signal emanated from aforesaid locomotive-mounted transceiver when in near proximity to one another; and an encased, miniaturized, motor vehicular-mounted, radio frequency compatible, radio frequency sympathetic, radio frequency discriminatory microprocessor receiver unit, provided with multiple visual/audio marked displays upon an integral faceplate; said receiver being powered by the vehicle's battery and said receiver sympathetically collects and discriminates signals emanating from said railroad crossing crossbuck pole mounted transceiver unit, to provide visual warning display and audio motorist alert to a "live railroad crossing" in near proximity.

2. A system for warning motorists of the approach of a locomotive and train into a highway/rail crossing, comprising:

an electrical radio frequency transceiver "beacon" constructed to provide a constant, directional, outgoing radio signal, said transceiver being mounted upon said locomotive, and said transceiver being provided with signaling means, to inform a locomotive operator that the outgoing radio signal has been received; and an intermittently active, railroad/highway crossing "crossbuck" pole-mounted, encased and weatherproof MHZ radio frequency transceiver unit, electrically powered by batteries and photovoltaic cells mounted upon the transceiver casing, and said crossbuck mounted transceiver emits an omnidirectional radio signal in a prescribed frequency, only upon a receipt of said outgoing radio signal provided by said locomotive-mounted "beacon" transceiver when in near proximity to one another; and an encased, miniaturized, motor vehicular-mounted, radio frequency compatible, radio frequency sympathetic, radio frequency discriminatory microprocessor receiver unit, provided with multiple visual/audio marked displays upon an integral faceplate; said receiver is battery powered, and has photovoltaic solar battery trickle charging panels integrated upon the receiver casing, and said receiver sympathetically collects and discriminates signals emanating from said crossbar mounted transceiver unit, to provide visual warning display and audio motorist alert to a "live railroad crossing" in near proximity.

* * * * *

UNITED STATES PATENT AND TRADEMARK OFFICE

CERTIFICATE OF CORRECTION

PATENT NO. : 4,942,395

DATED : Jul. 17, 1990

INVENTOR(S) : John S. Ferrari, Dale C. Sommers and David S. McFarland

It is certified that error appears in the above-identified patent and that said Letters Patent is hereby corrected as shown below:

On the title page, in item [76], add --David S. McFarland, 8030 E. Girard, Denver, CO. 80231--, as a co-inventor.

Signed and Sealed this

Seventh Day of January, 1992

*Attest:*

HARRY F. MANBECK, JR.

*Attesting Officer*

*Commissioner of Patents and Trademarks*